United States Patent [19]

Pal

[11] 4,083,550

[45] Apr. 11, 1978

[54] MULTIPLE COPY SORTING APPARATUS

[76] Inventor: Rajendra Pal, 500 Hind Nagar/Kanpur Road, P.O. Krishnanagar, Lucknow, India, 226005

[21] Appl. No.: 711,305

[22] Filed: Aug. 3, 1976

[51] Int. Cl.[2] ..... B42B 2/00

[52] U.S. Cl. ..... 270/53; 270/58

[58] Field of Search ..... 270/37–38, 270/53, 58; 271/173; 227/45, 48, 50, 3, 7, 100; 93/93 R, 93 DP

[56] References Cited

U.S. PATENT DOCUMENTS

| | | | |
|---|---|---|---|
| 2,793,032 | 5/1957 | Van Dusen | 227/45 |
| 3,884,408 | 5/1975 | Leiter | 270/58 |
| 3,995,748 | 12/1976 | Looney | 270/58 |

*Primary Examiner*—Edgar S. Burr
*Assistant Examiner*—A. Heinz

[57] ABSTRACT

A multiple copy sorting apparatus is disclosed for use in combination with a copying machine employed in making copies, said sorting apparatus comprising a plurality of trays which may be moved to receive a plurality of individual copies from the discharge end of a copying machine. A copy fastening member is provided to fasten and remove copies from the tray and deposit them in a copy receiving receptacle.

4 Claims, 7 Drawing Figures

MULTIPLE COPY SORTING APPARATUS

SUMMARY OF THE INVENTION

The present invention relates to a multiple copy sorting apparatus for use in combination with a copying machine employed in making copies consisting of individual sheets having indicia thereon. The sorting apparatus comprises a plurality of trays mounted in a rack and a member for moving each of the trays in the rack to receive a plurality of individual copies from the discharge end of a copying machine. A copy fastener is provided adjacent the rack for fastening copies together in the tray and removing copies from the tray. A member is also provided for positioning copies in the tray for engagement by the copy fastening member.

In a further embodiment the member for moving each of the trays in the rack comprises apparatus for positioning the trays for receiving a plurality of individual copies, one at a time from a copying machine reproducing a multiple page document.

In a further embodiment, the member for moving each of the trays comprises cycling apparatus for moving each tray into a copy receiving position with respect to the discharge end of a copying machine so that the last tray to receive an individual copy will be positioned to receive the next page of a multiple page document being copied when all trays succeeding the first tray contain the same copy as the first tray. This cycling apparatus comprises a vertical elevator for moving the trays upwardly and downwardly with respect to the discharge end of a copying machine. In an alternative embodiment, the cycling apparatus comprises a carrousel for moving each tray into a copy receiving position with respect to the discharge end of a copying machine so that the first tray to receive an individual copy will be positioned to receive the next page of a multiple page document being copies when all trays succeeding the first tray contain the same copy as the first tray.

In another embodiment, the member for positioning copies in the tray for engagement by the copy fastener comprise apparatus for removing the tray away from the rack to position the tray for engagement by the copy fastener and then moving the tray toward the rack. The copy fastener may comprise either a punch or a staple or a punch and staple in combination with one another. Where the latter embodiment is employed alternatively, apparatus for activating the punch independent of the staple may be provided such as a first plate slidably positioned over the staple apparatus and punch apparatus, and a first cam mounted over the first plate for moving the first plate into operative engagement with punch and staple apparatus. Apparatus is also provided in this embodiment for moving the plate away from the staple apparatus so that only the punch may be activated by the first plate. Second plate is positioned under the first plate and in between the punch. A second cam operatively engages the second plate downwardly to remove copies from the punches after the fastening apparatus has emptied the tray and the empty tray returned to the rack.

DETAILED DESCRIPTION

Apparatus for collating multiple copies and for sorting and transferring multiple copies are disclosed in the prior art U.S. Pat. Nos. 2,977,33 Pearce; 2,827,159 Peteler; 2,783,873 Lowe; 2,649,675 Schrage; and 2,645,365 Haessler.

The objects of the present invention will become apparent from the disclosure and claims that follow as well as the appended drawing.

Figures 1, 2, 3, 4, 5:
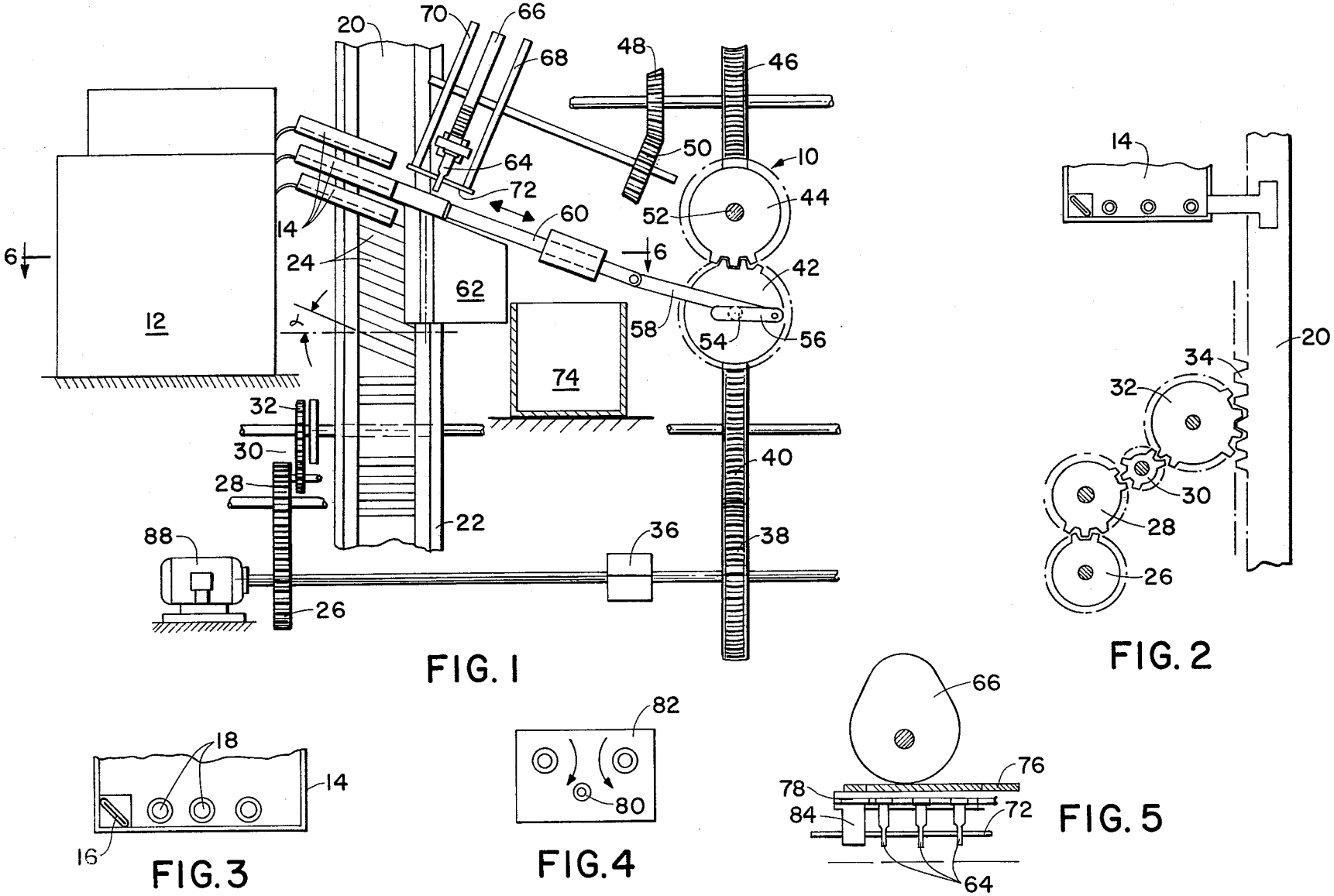
FIG. 1 is a side elevation partially in section illustrating multiple copy assorting apparatus for use in combination with a copying machine having a plurality of trays mounted on a rack that may be moved vertically or as a continuous belt rack in carrousel fashion, apparatus being provided for positioning copies in the tray for engagement by the copy fastening member and for fastening copies together in the tray and removing them according to one embodiment of the present invention.
FIG. 2 is a plan view partially in section illustrating apparatus for positioning copies in the trays for engagement by the copy fastener apparatus according to another embodiment of the present invention.
FIG. 3 is a plan view in section showing staple die and punch dies in a bottom of a tray according to another embodiment of the present invention.
FIG. 4 comprises a plan view of a control panel used according to the present invention.
FIG. 5 comprises a side elevation of a cam used for activating punches and a stapler or punches alone according to another embodiment of the present invention.
Figure 6:
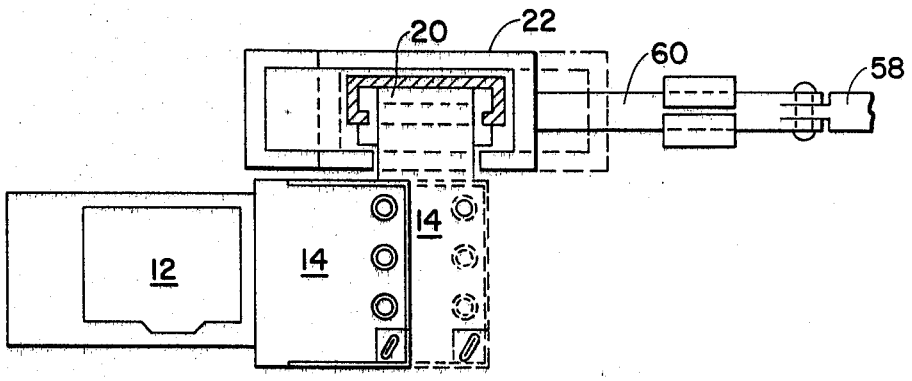
FIG. 6 is a plan view taken along the line 6—6 of FIG. 1.

Referring to the drawing, multiple copy sorting apparatus 10 is illustrated for use in combination with a copy machine 12. A plurality of trays 14 up to a maximum of say about 10 trays are provided. A typical tray is usually constructed of a plastic material and is shown in FIG. 3 having a staple die 16 made of metal and a plurality of punch dies or piercing dies 18 made of metal and positioned in the bottom of tray 14. The trays are attached to a rack 20 which moves up and down in a fixed socket or guide 22, the rack 20 being either a vertically movable rack for movement in an upward and downward position or a carousel type of rack, i.e., an endless belt rack so that the trays rotate around the rack in the guide 22. It is preferred that the rack 20 is provided so that the trays 14 move vertically up and down inside the fixed guide 22. The friction between the rack 20 and the socket 22 as well as the trays 14 and the rack slots 24 in which the trays ride is such that the rack and trays will not move downward by gravity only. The rack 20 moves in a start-stop-start cycle with the help of speed reducing gears 26, 28, 30 and 32, gear 32 having one tooth only and acting as a pinion gear for engaging rack teeth 34 on rack 20. The gear train is selected so that the rack can be made to move up and down after a predetermined number of start-stop-start cycles, i.e., the direction of the rack motion can be reversed after vertical movement of the trays. The trays are attached to the rack 20 such that they make an angle alpha of say about 15° to the horizontal.

A clutch 36 is provided to drive gears 38, 40, 42, 44, 46, 48 and 60, gears 42 and 44 being driven by a worm gear on shafts 52 and 54, respectively, this worm gear not being illustrated. A crank 56 connected to a linking rod 58 is provided on gear 42, link 58 being operatively connected to a yoke 60 which is moved into engagement with any one of the trays 14. This causes one of the trays 14 to be moved forward to rest on a platform 62. Platform 62 is metallic and has a smooth surface with various holes drilled to receive slugs after the copies in the tray have been punched by means of punch member 64. The holes in the platform 62 are compatible with those in the trays 14 and with the punches 64 as shown in FIG. 5. A typical punch is slightly tapered as shown in FIG. 5 the walls thereof making an angle of about 2° with the axis of the punch. This makes the papers or copies engaged by the punch 64 cling to the punch. In order to remove copies from the punch cams 68 and 70 are provided on the same shaft as gear 50 which operates the staple and punch unit. Cams 68 and 70 are set in relation to cam 66 such that when cam 66 makes the punches return after the punching operation, cams 68 and 70 engage a paper ejector plate 72 pushing copies or papers downward on to platform 62 and into a collector 74. Operating a knob 80 on control panel 82 causes the plate 76 to disengage from the strip 78 or top of stapler 84 so that only the punches 64 are operated by cam 66 and no stapling is performed when cam 66 is brought down into contact with plate 76. When plate 76 is positioned over strip 78, a simultaneous punching and stapling operation is performed.

Figure 7:
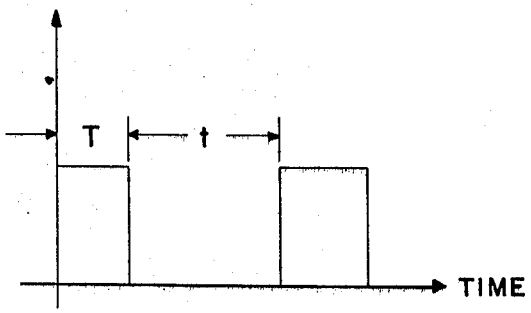
FIG. 7 comprises a time chart for the various operations performed by the apparatus according to another embodiment of the present invention.
Figure 7:
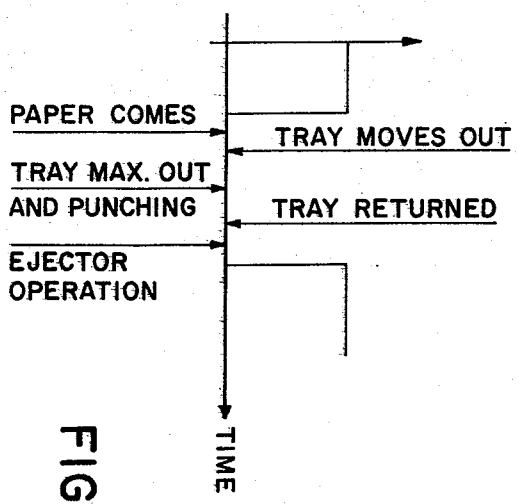

The various timing functions are illustrated in the time chart of FIG. 7 where "T+*t*" is the time taken by the photocopying machine to supply a copy after the first copy. The next tray will occupy the position of the first tray in "T+*t*" time. "T" is the time in which the tray moves to the next position and "*t*" is the time it stays at that position. Thus, "T+*t*" represents a start-stop cycle. During the punching and stapling cycle, the time "*t*" is the time in which the tray receives paper from a stop position, is moved forward, papers are punched and stapled and the tray reverts to its original position. FIG. 7 also shows the time when the ejector operates. All times are precisely maintained by proper gear and cam selection.

In use, the trays 14 face the outlet of a photocopying machine 12. Clutch 36 is disengaged and six copies of a nine page document are arranged for copying by machine 12. A first copy of the first original will fall into the first tray. Due to the motor 88 moving the gears and rack previously described and illustrated in FIG. 2, the second tray 14 moves to the position of the first tray in time "T" and stays there for time "*t*" in which time the second copy of the first original falls into the second tray. Thus, the sixth copy of the first original can be placed in the sixth tray. A limit switch or counter then reverses the rack directly by introduction of an idler gear in the gear train. The first copy of the second original falls in the sixth tray. The second copy of the second original falls in the fifth tray and this goes on until the sixth copy of the second original falls in the first tray. Alternatively, where the rack comprises a carrousel, the first copy and the second copy will always be in the first tray. The limit switch or counter system again changes the direction of rack movement. This process goes on until the sixth copy of the eighth original have been gathered by the sixth tray. At the beginning of the first copy of the ninth page, ninth original, clutch 36 engages electromagnetically and operates the stapling and punching unit. Then the first copy of the ninth original falls in the first tray. The yoke 60 is then moved forward to grasp a tray 14 and cam 66 is engaged to operate the stapling and punching unit as shown in FIG. 7. The stapling and punching unit moves upwards and the yoke 60 moves backward away from the copying machine. Cams 68 and 70 operate ejector plate 72 forcing papers downward into the collecting bin 74 through platform 62. The first tray now emptied moves to its original position and the second tray then comes to take the place of the first tray and receives the second copy of the ninth original and goes through the same cycle as the first tray. Thus immediately after the sixth copy of the ninth original has been supplied by the photocopying machine, six copies of a nine page document are provided in the collector 74 all stapled and punched properly.

Although the invention has been described by reference to certain embodiments, it is not intended that the novel multiple copy sorting apparatus be limited thereby but that modifications thereof are intended to be included as falling within the broad scope and spirit of the foregoing disclosure, the following claims and the appended drawing.

I claim:

1. A multiple copy sorting apparatus for use in combination with a copying machine employed in making copies consisting of individual sheets having indicia thereon, said sorting apparatus comprising a plurality of tray means for holding paper and mounted on rack means for positioning said tray means in relation to a copying machine, means for moving each of said tray means in said rack means to receive a plurality of individual copies from a copying machine, copy fastener means adjacent said rack means for fastening copies together in said tray means, means for positioning copies in said tray means for engagement by said copy fastener means, said means for positioning copies in said tray means comprising means for removing said tray means away from said rack means and to position copies in said tray means for engagement by copy fastener means that simultaneously fastens said copies and empties said copies from said tray means and then moving said empty tray means towards said rack means.

2. The multiple copy sorting apparatus of claim 1 where said copy fastener comprises punch means for impaling copies.

3. The multiple copy sorting apparatus of claim 1 where said copy fastener means comprises punch means for impaling copies and staple means for fastening copies together, said punch means and staple means comprise first plate means for operatively engaging said staple means and said punch means and slidably positioned over said staple means and said punch means, first cam means mounted over said first plate means for moving said first plate means into operative engagement with said punch means and staple means, means for moving said first plate means away from said staple means so that only said punch means may be activated by said first plate means, second plate means positioned under said first plate means for removing copies impaled on said punch means, second cam means for moving said second plate means downward to remove copies off of said punch means after said empty tray means is returned to said rack means, said removed copies being discharged into receptacle means for receiving copies.

4. The multiple copy sorting apparatus of claim 1 where said fastener means comprises first cam engaging means for operatively engaging said fastener means and positioned over die means for receiving said fastener means, first cam means mounted over said first cam engaging means for moving said first cam engaging means into operative engagement with said fastener means, said fastener means retaining copies thereon from said tray, copy removing means positioned adjacent said fastener means for removing copies therefrom after said empty tray is returned to said rack, said removed copies being discharged into receptacle means for receiving copies.

* * * * *